US007062788B2

(12) United States Patent
Tremblay-Lutter et al.

(10) Patent No.: US 7,062,788 B2
(45) Date of Patent: Jun. 20, 2006

(54) THIN, STRETCHABLE CHEMICAL VAPOR PROTECTIVE GARMENT WORN NEXT-TO-SKIN

(75) Inventors: Julie Tremblay-Lutter, Stittsville (CA); E J Scott Duncan, Medicine Hat (CA); Tannis Grant, Medicine Hat (CA); Eva F. Gudgin Dickson, Kingston (CA); Ben Lacroix, Medicine Hat (CA)

(73) Assignee: The Minister of National Defence of Her Majesty's Canadian Government (CA)

( * ) Notice: Subject to any disclaimer, the term of this patent is extended or adjusted under 35 U.S.C. 154(b) by 36 days.

(21) Appl. No.: 10/167,492

(22) Filed: Jun. 13, 2002

(65) Prior Publication Data

US 2003/0229936 A1 Dec. 18, 2003

(51) Int. Cl.
*A41D 13/00* (2006.01)
*A41B 11/00* (2006.01)

(52) U.S. Cl. ..... 2/69; 2/239; 2/159; 2/174; 2/202; 2/243.1; 2/164

(58) Field of Classification Search ..... 2/239, 2/159, 174, 202, 69, 79, 243.1, 164; 428/175, 428/408; 156/212; 442/246, 296
See application file for complete search history.

(56) References Cited

U.S. PATENT DOCUMENTS 4,067,210 A * 1/1978 Arons et al. ..... 66/202
4,256,786 A * 3/1981 Dias et al. ..... 427/244
4,954,392 A * 9/1990 Goldberg ..... 442/315
5,017,424 A 5/1991 Farnworth et al.
5,190,806 A * 3/1993 Nomi ..... 428/198
6,286,144 B1 * 9/2001 Henderson et al. ..... 2/69
6,571,397 B1 * 6/2003 Williams ..... 2/239
6,662,377 B1 * 12/2003 Williams ..... 2/239

OTHER PUBLICATIONS

McLellan T. M. et al., "Influence Of A New Vapor Protective Clothing Layer On Physical Work Tolerance Times At 40° C. Ambient Temperature", DCIEM 91-35 (1991).
M.E.T.A. Research Inc., "Prototype Barrier Laminates—Final Report", Contractor Report No. 02PW.W7714-9-9101, (1993).
Duncan E.J.S. et al., "The Canadian Vapour Protection System Tests: A Novel Methodology To Assess The Protection Capability of CB Protective Ensembles", Proceedings of the Sixth International Symposium on Protection Against Chemical and Biological Warfare Agents, Stockholm, Sweden, (1998).
Duncan S. et al., "System Protection Performance of a Next-to-Skin Chemical Vapour Protective Suit", Proceedings of the Seventh International Symposium on Protection Against Chemical and Biological Warfare Agents, Stockholm, Sweden, (2001).

* cited by examiner

*Primary Examiner*—John J. Calvert
*Assistant Examiner*—Robert Muromoto
(74) *Attorney, Agent, or Firm*—Rader, Fishman & Grauer PLLC

(57) ABSTRACT

A thin, stretchable chemical vapor protective garment worn next-to-skin is disclosed. The protective undergarment is made of material that stretches and is capable of efficient elimination of air spaces between the undergarment and the user's body, thus enabling the user to wear other operational clothing over top.

9 Claims, 13 Drawing Sheets

Area-weighted average Protection Factor for NTS under Level C (standard wind) is 5233

Area-weighted average Protection Factor for NTS under infantry combats is 1264

Area-weighted average Protection Factor for NTS under Civilian casual wear is 897

Area-weighted average Protection Factor for NTS under Bomb disposal suit is 1387

Area-weighted average Protection Factor for Level A is 2733

Area-weighted average Protection Factor for Level C suit with no NTS is 12

Area-weighted average Protection Factor for Conventional Overgarment is 147

Area-weighted average Protection Factor for Light weight Standalone is 268

Area-weighted average Protection Factor for NTS Nomex lined under Aircrew is 2640

Area-weighted average Protection Factor for NTS mesh inserts under Aircrew is 5766

THIN, STRETCHABLE CHEMICAL VAPOR PROTECTIVE GARMENT WORN NEXT-TO-SKIN

FIELD OF INVENTION

The present invention relates to a thin, stretchable chemical vapour protective garment for wearing next-to-skin underneath other suitable operational clothing.

BACKGROUND OF THE INVENTION

Chemical protective garments have traditionally consisted of coverall concepts or stand-alone concepts. The former is an overgarment designed to be worn over existing operational clothing. It consists of an outer shell layer and a chemical adsorptive layer. The adsorbing component of the chemical adsorptive layer typically consists of an activated carbon which acts to filter out toxic chemicals from the air that passes through it. These coverall concepts are typically bulky and not tailored because of the requirement to fit over other clothing. There is generally a significant volume of air space within these protective systems, both between the protective coverall and the operational clothing underneath, and between the operational clothing and the body. A stand-alone protective garment is a lighter version of the protective coverall. It is typically only worn over boxer shorts and a T-shirt. The stand-alone protective garment consists of a liquid repellent outer shell layer, a chemical vapour adsorptive layer and a skin comfort layer.

The bulky and loose fitting nature of the coverall and standalone chemical protective garments tend to promote a bellows effect when the garment is worn, which is the movement of the fabric layer relative to the body during active wear. The bellowing effect acts much like a pump, drawing air that is potentially contaminated with harmful chemicals, inside conventional protective garments mainly through closures (hood/respirator interface, wrists, ankles and zippers etc), but also through the fabric itself. Once the contaminated air breaches the protective coverall or stand-alone garment and penetrates inside, it can be absorbed by the skin with possible health risks to the individual if the exposure level exceeds the allowable dose.

Accordingly, there is a long-felt need to have a thin, stretchable chemical vapour protective garment which allows the user to wear it next-to-skin and beneath other operational clothing to protect the skin from direct exposure to unfiltered, air containing harmful chemicals.

The concept of skin tight protective suit for noxious chemicals was disclosed in U.S. Pat. No. 5,017,424 (Farnworth et al.), which is incorporated herein by reference. Farnworth et al. discloses a composite material resistant to passage therethrough of noxious substances. The composite material is comprised of a first layer impermeable to water and particulate materials but permeable to vapours that takes the form of a film; a second layer of vapour permeable stretch fabric material; and a third layer disposed between the first and second layer and consisting of vapour permeable stretchable fabric material containing a particulate adsorbent material to remove the noxious vapours. However, protective suits which require multiple layers of fabric means that they are more suitable to be worn as the only garment. Only in non-heat stress conditions can they be worn as an undergarment. This poses a practical problem in arduous, real life operations where special operating clothing are required to be worn over the protective suit.

It is therefore desirable to have chemical vapour protective suits for wearing next-to-skin as undergarments which allow the users to wear their own specialized operational clothing over top, such as a bomb disposal overall, special forces combats or coveralls, fighter jet pilot coveralls, first responder protective gear, etc.

SUMMARY OF INVENTION

By incorporating a thin, stretchable fabric containing a chemical adsorbent into a close-fitting, next-to-skin undergarment design enables the present invention to provide a chemical protective system with minimal air space next to the body, one which affords a superior level of chemical vapour protection compared to conventional standalone or overgarment chemical protective concepts, and which imposes a minimal functional burden to the user.

In accordance with one aspect of the present invention, there is provided a thin, stretchable chemical vapour protective garment for wearing next-to-skin.

In accordance with another aspect of the present invention, there is provided a method for wearing the thin, stretchable chemical vapour protective next-to-skin garment such that there is no extraneous space between the skin of the wearer and the garment.

BRIEF DESCRIPTION THE DRAWINGS

FIG. 3 shows results of geometric mean Protection Factors ("PFs") measured on the body when the NTS chemical protective suit is worn under (a) NTS suit—Level C wind-impermeable coveralls (<0.5 $m.s^{-1}$), (b) NTS suit—Level C wind-impermeable coveralls (1.6 $m.s^{-1}$), (c) NTS suit with aircrew/infantry combat clothing, (d) NTS suit with civilian casual wear and (e) NTS suit with bomb disposal suit. Maximum assigned PF: 10000 for (a), (b), (d); 2000 for (c), (e).

Figure 4:
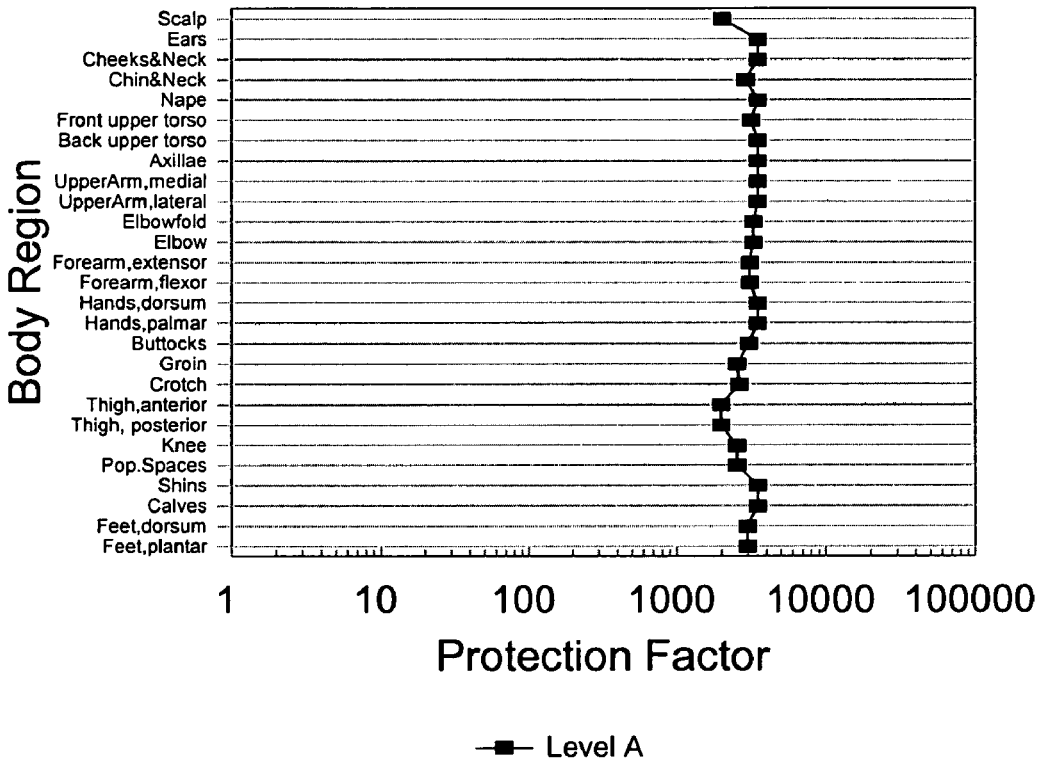

FIG. 4 shows results of geometric mean PFs for a fully encapsulated Level A protective suit with self-contained breathing apparatus.

Figure 5:
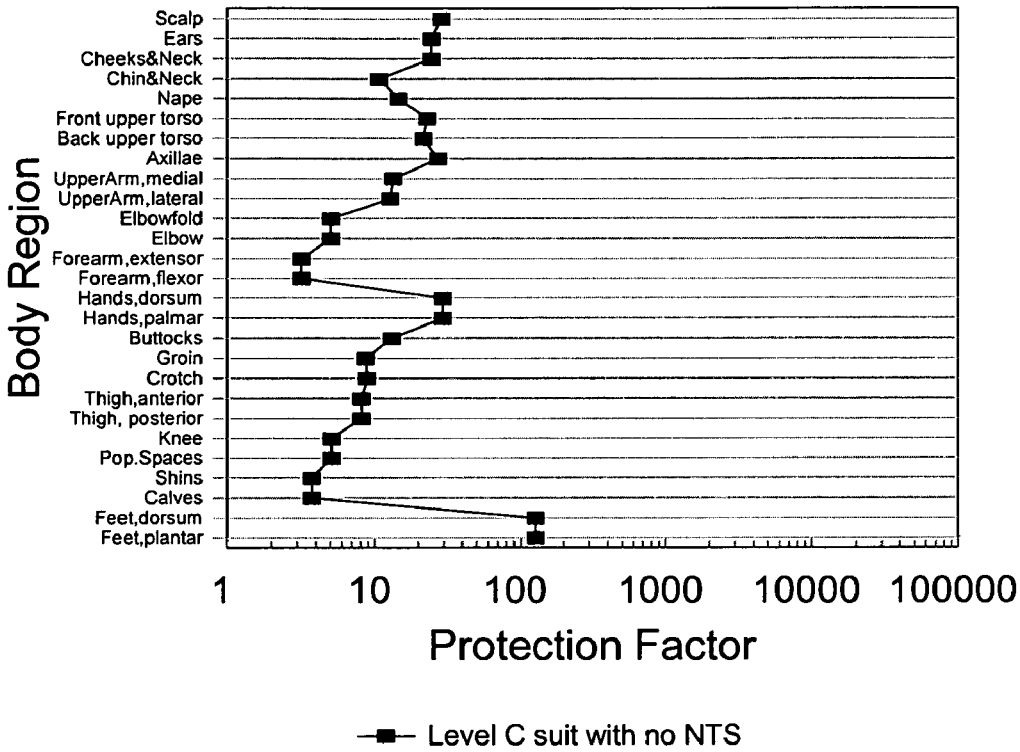

FIG. 5 shows results of geometric mean PFs for a Level C impermeable suit with no NTS suit worn underneath.

Figure 6:
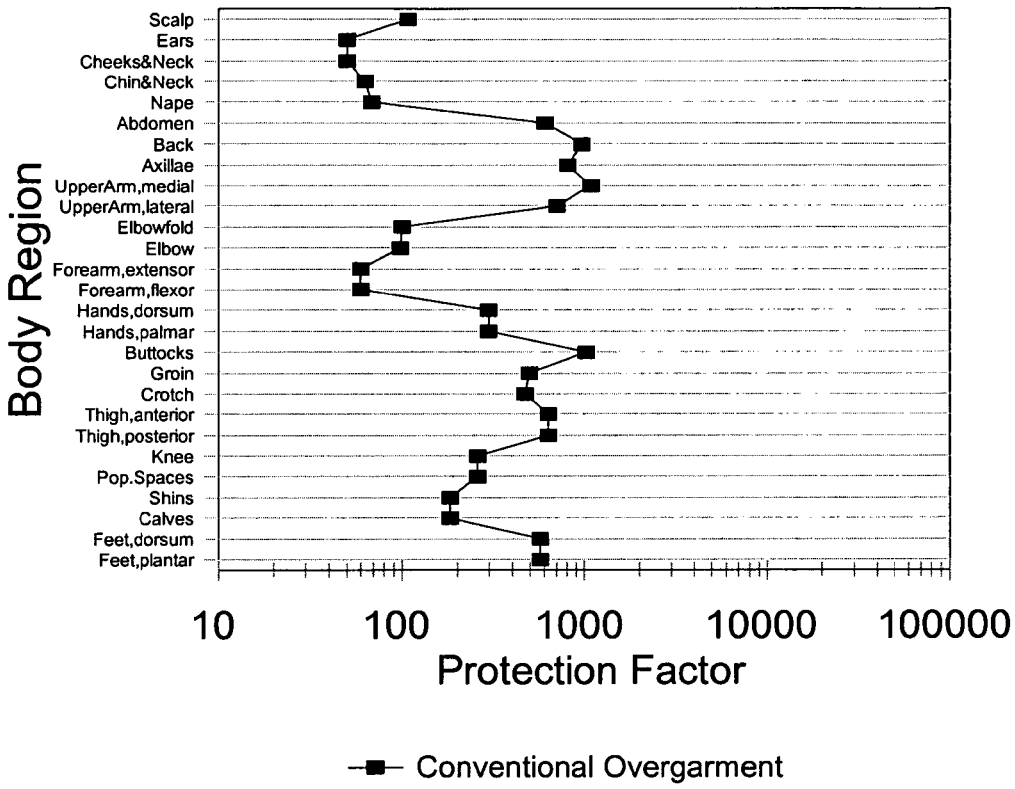

FIG. 6 shows results of geometric mean PFs for a conventional chemical protective overgarment.

Figure 7:
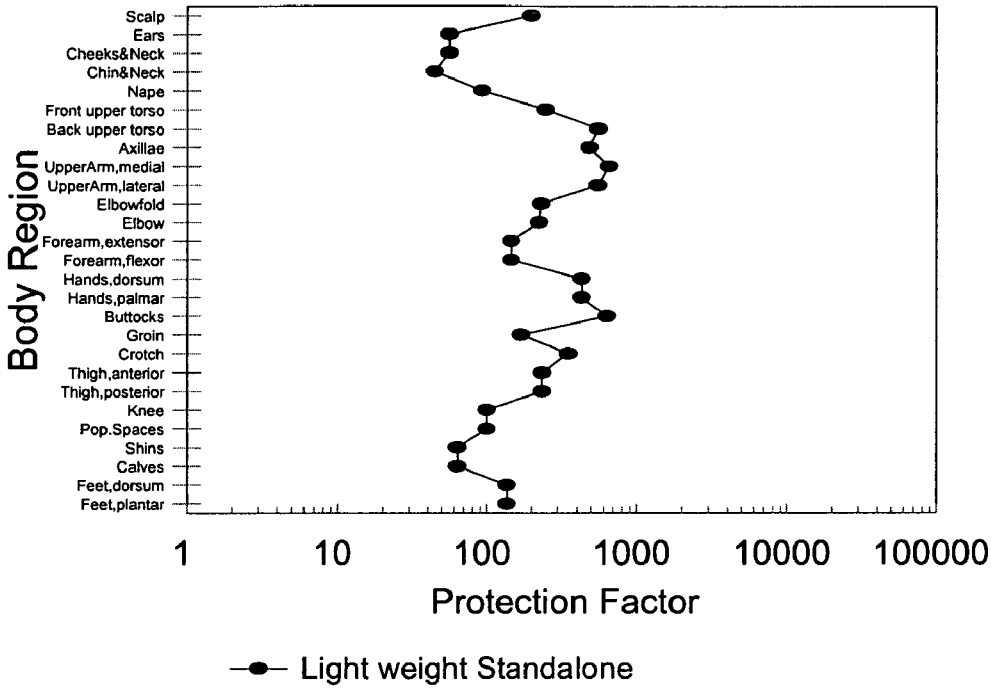

FIG. 7 shows results of geometric mean PFs for a lightweight stand-alone chemical protective suit.

Figure 8:
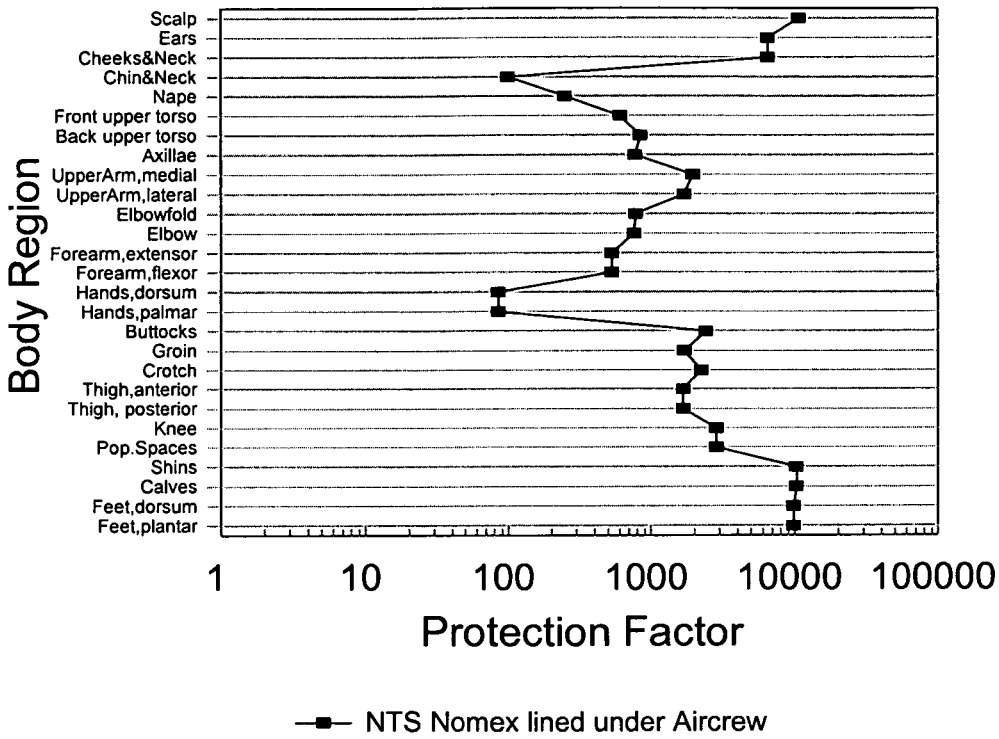

FIG. 8 shows PF profile obtained from a NTS suit/aircrew combat coverall configuration with fit problems at the neck region.

Figure 9:
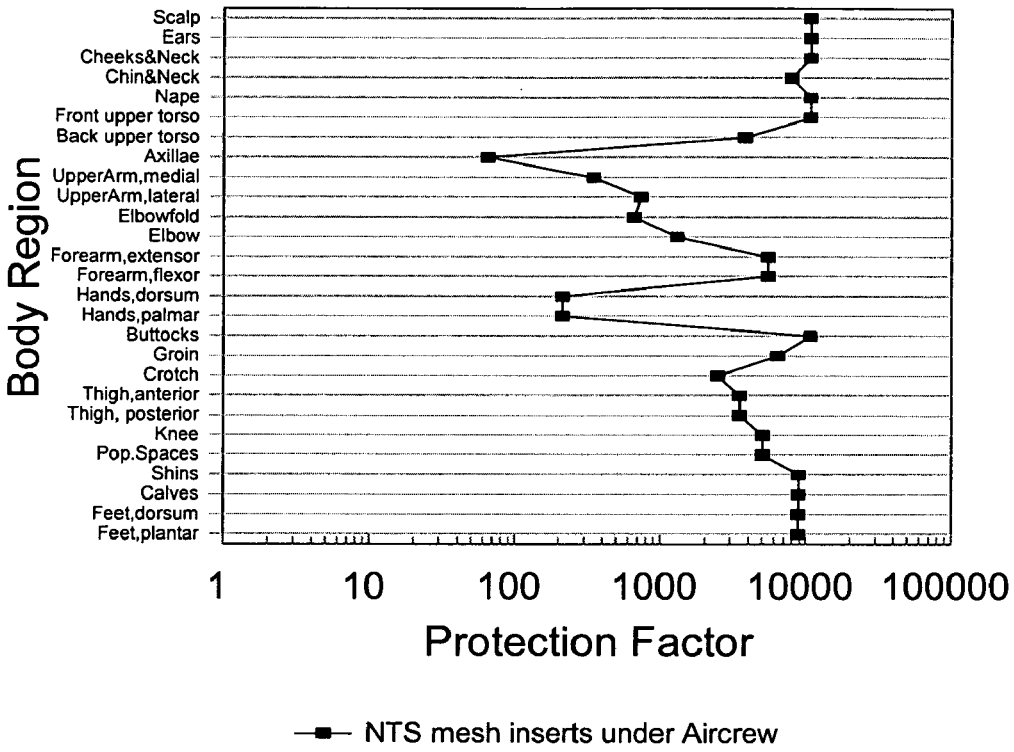

FIG. 9 shows PF profile obtained from a NTS suit/infantry combat clothing configuration with modification to incorporate passive venting under the arm to aid in body cooling.

DETAILED DESCRIPTION OF THE INVENTION

The next-to-skin ("NTS") chemical protective garment is designed to fit the wearer like a "second skin". It is constructed from a stretchable fabric containing an organic chemical vapour adsorbent having a total thickness not exceeding 1.0 mm. This type of fabric system is critical to the chemical protective capability of the garment and the user functionality. The stretchable fabric ensures that the garment can be constructed so that it fits tightly to the skin of the wearer. Typically there should be no extraneous space between the skin of the wearer and the NTS garment. This allows the NTS suit to be worn under other specialized operational clothing with minimum interference and bulk. The close fit means that the air space between the NTS suit and the skin is very small. This provides for a greater efficiency of scavenging and adsorption by the carbon in the NTS garment due, in part, to shorter diffusion paths. In addition, the close fit of the NTS suit effectively eliminates the bellowing effect, resulting in little, if any, air forcibly penetrating through the closures of the suit. When a NTS suit is worn under specialized operational clothing which then bellows during active wear, the air/vapour will be drawn into the air space between the NTS suit and the outer garment rather than between the NTS suit and the skin. Once in this air space, to reach the skin the vapour must still permeate through the carbon adsorbent layer in the NTS garment. Thus direct, unfiltered exposure to the skin by harmful chemical vapours is avoided. This is markedly different than what occurs with conventional overgarment or standalone chemical protective suits. Vapour penetrating through closures on these garments does so into the underlying air space that is immediately adjacent to the skin and is then free to be absorbed by the skin because the carbon adsorbent layer is generally laminated within the fabric system and not held close against the skin.

Figure 1:
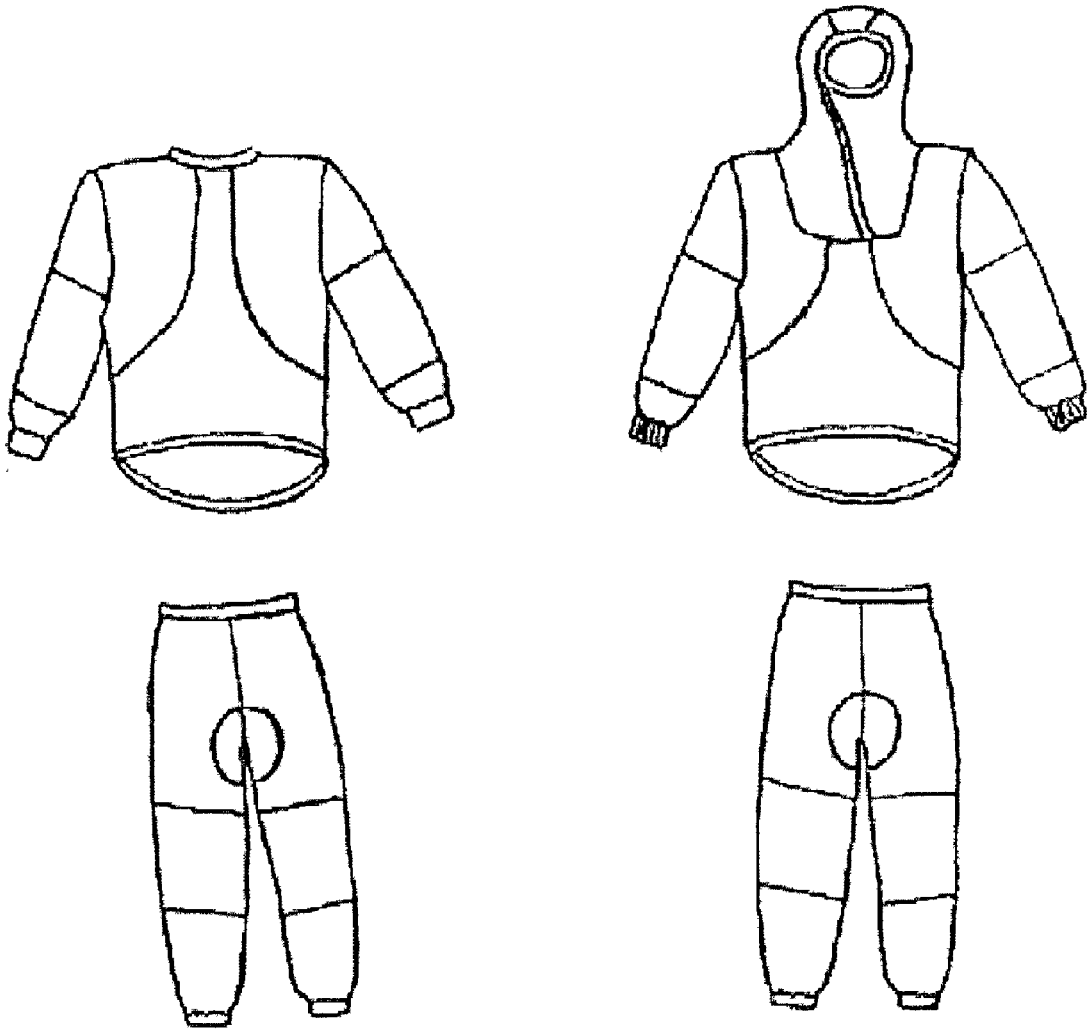
FIG. 1 shows sketches of two-piece next-to-skin ("NTS") design according to the present invention.

The NTS garment may consist of a three-piece design (pants, jersey, hood), or a two-piece design (pants, jersey with integral hood), or a one-piece, whole-body integral design. FIG. 1 shows sketches of two-piece NTS concept design.

The NTS garment is to be used by personnel who are required to wear specialized operational clothing on top and/or who must undertake specialized tasks when there is a risk of exposure to chemical warfare agents. The NTS garment will provide optimal protection to the body against chemical agent vapours whilst minimizing the functional burden to the user.

Vapour Protection Test

The system protection performance of the NTS suit was investigated using the Canadian system level vapour protection (VAPRO) methodology developed by the inventors (Duncan E J S, Gudgin Dickson E F, Weagle G E and Tremblay-Lutter J. *The Canadian vapour protection systems test: A novel methodology to assess the protection capability of CB protective ensembles*. Proceedings of the Sixth International Symposium on Protection Against Chemical and Biological Warfare Agents, Stockholm, Sweden, May 1998, p 245–251), which is incorporated herein by reference.

The VAPRO systems test uses methyl salicylate (MeS) as the operative chemical agent simulant for its low toxicity and close approximation of some physical characteristics of H vapour. The standard VAPRO systems test is 120 minutes in duration and is conducted at a temperature of 27±0.5° C., relative humidity of 55±5%, and wind speed of 1.6±0.5 $m.s^{-1}$. The standard concentration of MeS in the vapour chamber is 95±10 $mg.m^{-3}$ (as measured by a real-time miniature infra-red analyser, and also by independent analysis of chamber air samples). The chamber concentration-time (Ct) dosage is 11400±1200 $mg.min.m^{-3}$. As this is a vapour challenge test, every step is taken to avoid generation of liquid aerosol.

Figure 2:
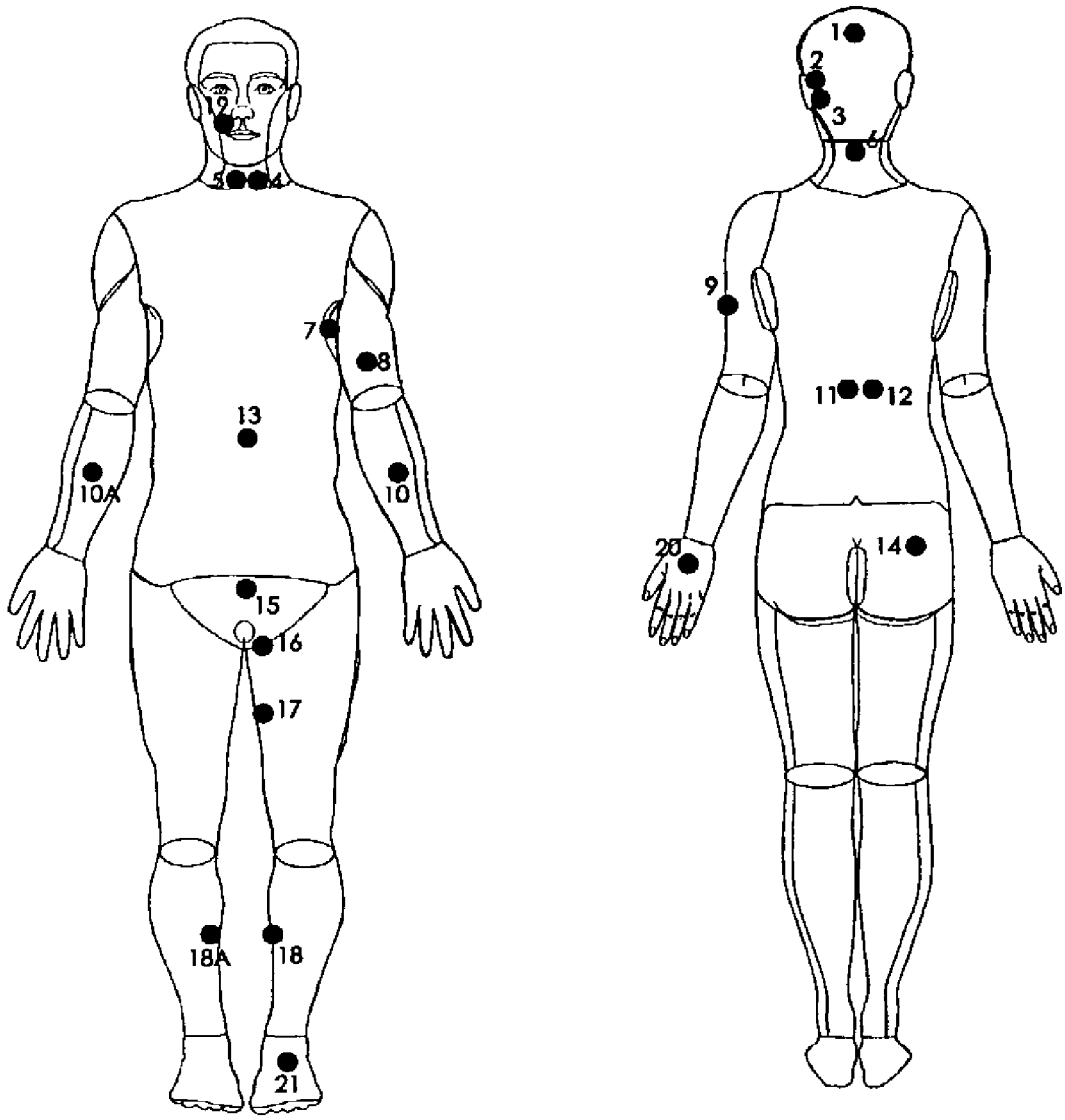
FIG. 2 shows the locations of Passive Adsorption Dosimeters ("PADs") on test subjects.
Figure 3A:
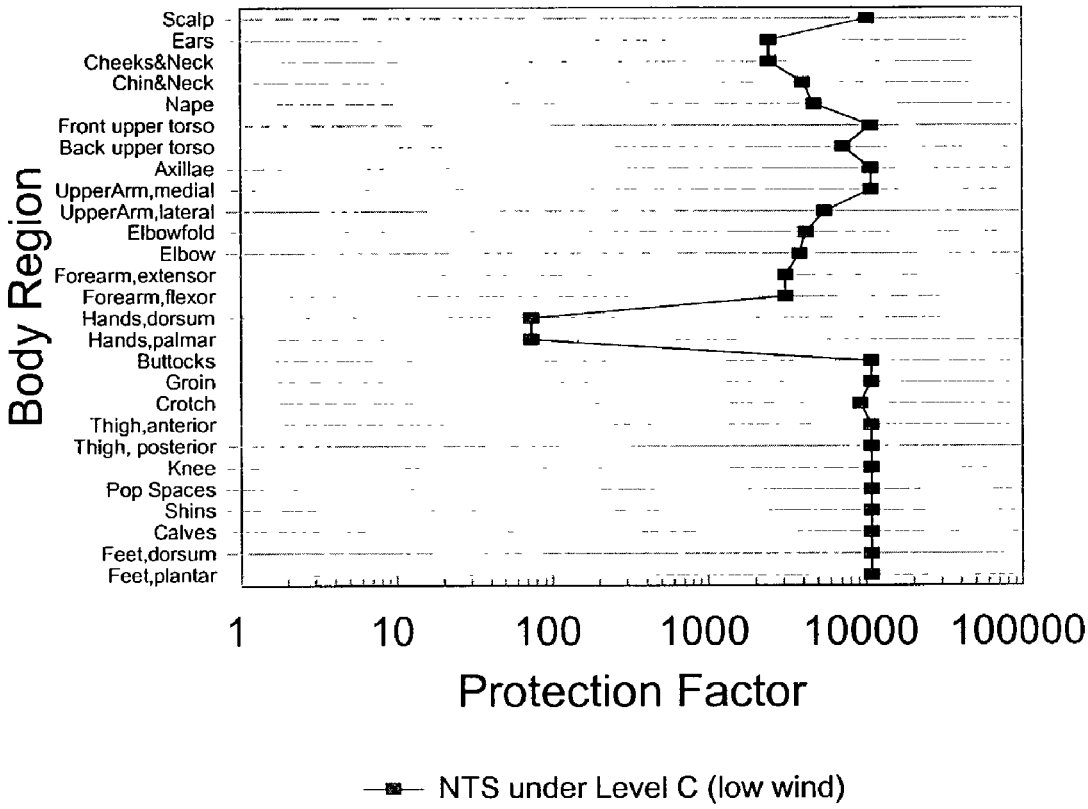
Figure 3B:
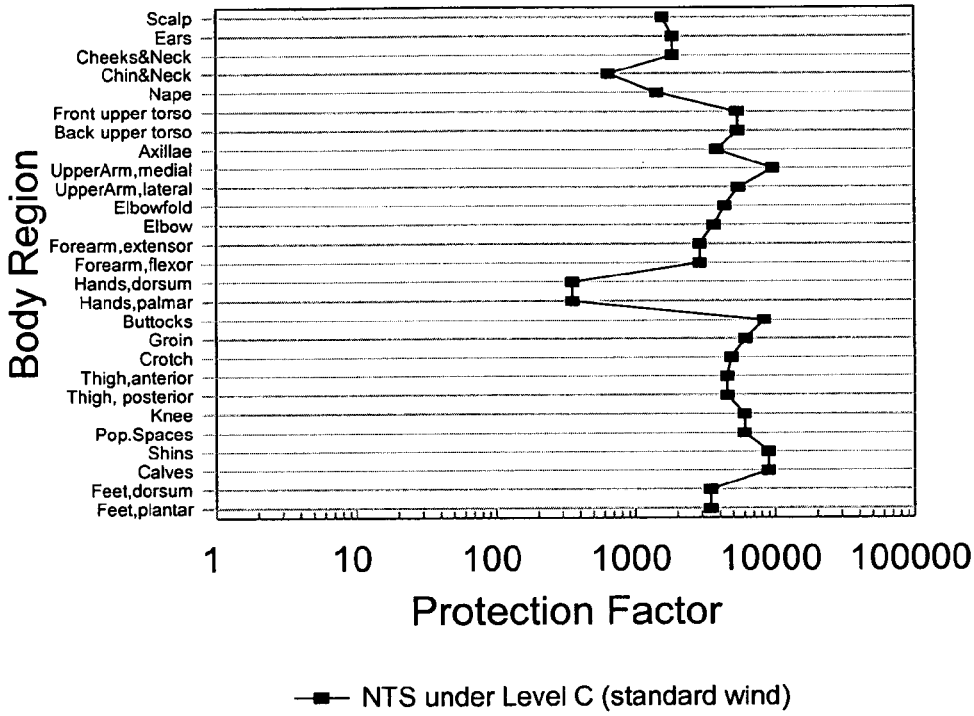
Figure 3C:
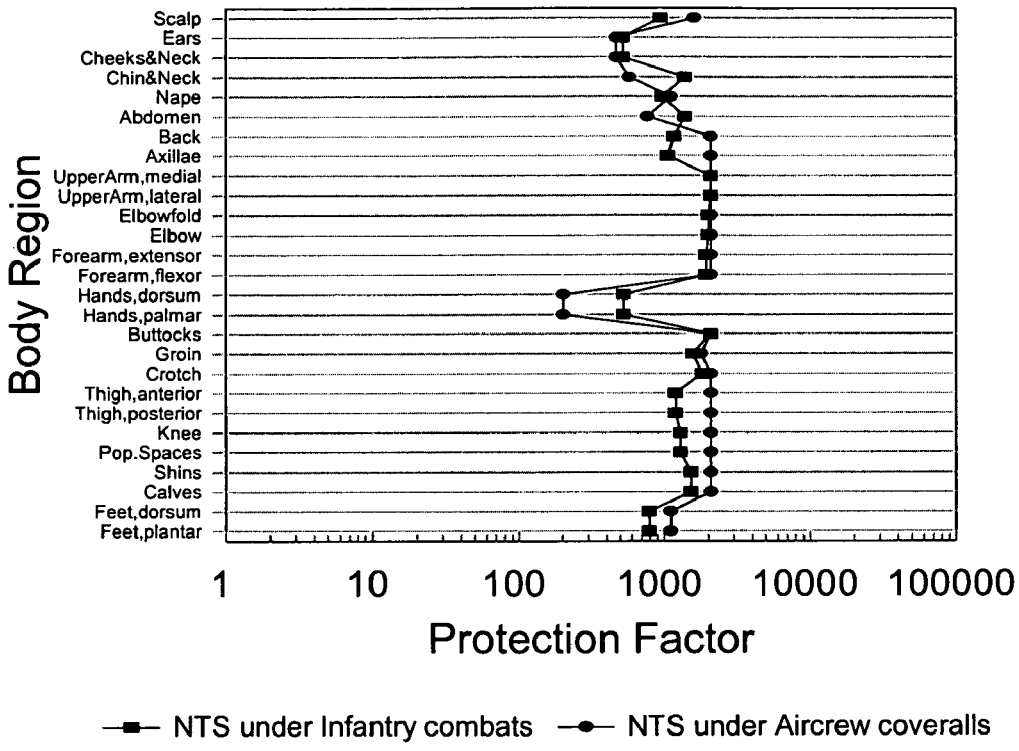
Figure 3D:
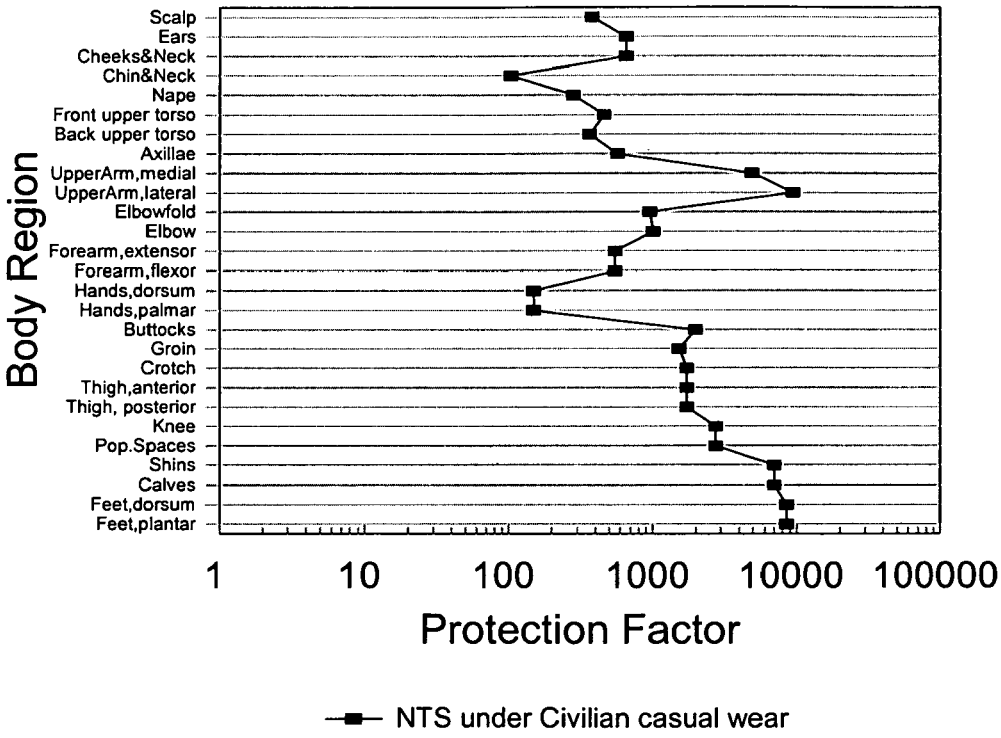
Figure 3E:
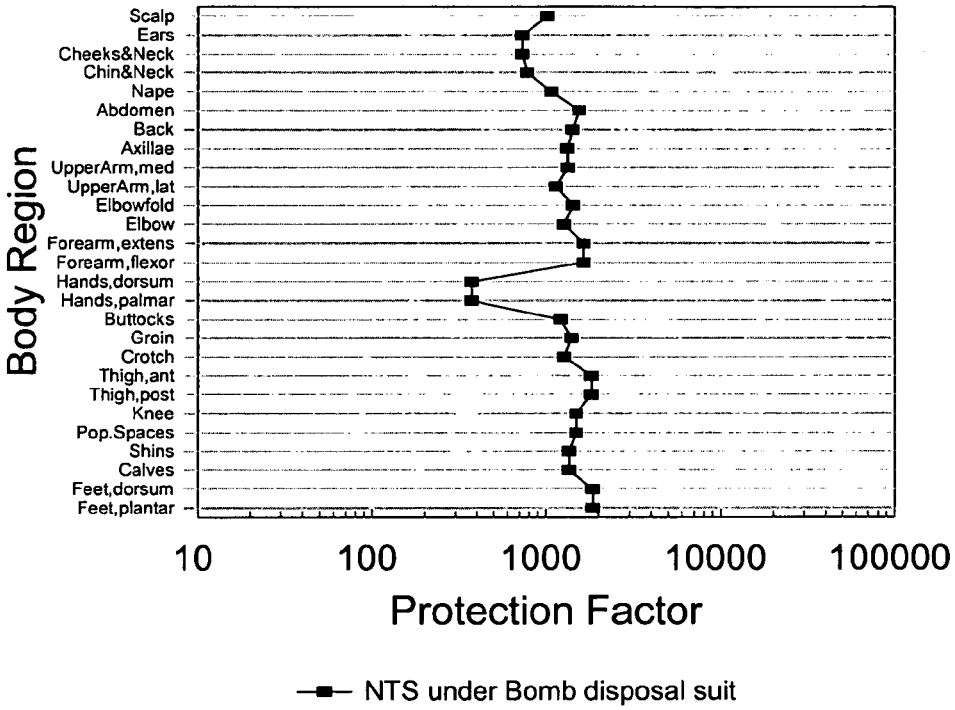

The standard VAPRO systems test is conducted using Passive Adsorption Dosimeters (PADs) that affix directly to the skin of the test subjects. They were designed to have an adsorption rate of the same order of magnitude as human skin and thus will adsorb a representative portion of the simulant that penetrates the suit. The PAD currently in use (Syon Corp., Ashland Mass.) was developed by the US Army Natick Engineering Research and Development Centre. It is an adhesive-backed foil packet measuring 2.5×3.5×0.2 cm, which contains an adsorbent material covered by a high-density polyethylene film that acts as a pseudo-skin barrier. The active surface sampling area of a PAD is approximately 4.1 $cm^2$. PADs are placed at the body region locations shown in FIG. 2, chosen to reflect both the regional sensitivity of the body to agent uptake, and important garment design characteristics. Additional PADs are used to conduct background sampling and for quality control during the test.

All PADs are applied in a clean dressing area, by personnel that have followed pre-trial procedures to minimize contamination (also required of test participants). Every effort is made to follow the standard operating procedures for donning the chemical and biological ("CB") protective ensemble, and to ensure that the clothes worn underneath the CB protective ensemble, as well as the other protective equipment (respirator, boots and gloves), are appropriate for wear with the garment being tested. Once the test participants are outfitted in the ensembles, they proceed to the vapour chamber. During the 2 hour standard VAPRO system test, participants perform a series of physical activities interspersed with rest periods. The activity regime consists of four different activities that provide a full range of motion, and uniform exposure of the protective ensemble to the wind stream. The individual's physical activity level is considered to be the paramount consideration in determining one's impact on the protective capability provided by a CB protective ensemble.

After completion of the VAPRO chamber test, the subjects move to the decontamination room. The respirator, boots and gloves are washed with a strong soap solution. These items are then disposed of in such a way that they pose no further danger of contaminating the exposed PADs. The subjects then move to the first undressing room where the PADs exposed on the head, neck and hands are removed. The CB protective ensemble is then doffed and then the remainder of the PADs are removed. Each PAD is backed with aluminium foil, placed in individual sealed glass vials with a non-adsorbent lid liner, and stored in a refrigerated environment (4° C.). Analysis is performed commencing 24±8 hour after exposure. PADs are analyzed using solvent extraction of the adsorbent, followed by high pressure liquid chromatography (HPLC) with absorption detection. The detection limit is 50 ng MeS/PAD. The results of the PAD analysis are used to derive the Protection Factors ("PFs") at each region under the suit. The PF is the ratio of the mass of chemical adsorbed on the sampling dosimeter when an individual does not wear chemical protective clothing to the mass adsorbed on the dosimeter when chemical protective clothing is worn. The distribution and magnitude of the PFs is a direct measure of the degree of protection that the CB protective ensemble affords the test participant at each body region.

Protective Ensembles

The NTS suits of the present invention are close-fitting, three-piece or two-piece designs, consisting of leggings, jersey and hood or jersey with integral hood. Two different carbon adsorbent fabrics have been used in the development of the NTS suit concept, namely a carbon impregnated stretch-nylon or a commercially available activated carbon knit. It is preferred that a carbon impregnated stretch-nylon laminated to a knit, or an activated carbon knit laminated between two thin knits is used. The NTS suit is typically worn over cotton boxer shorts and t-shirt or thin long-underwear. Activated carbon socks (made of thin material either the same or substantially similar to the material used in the NTS suits) are also worn with the NTS suit. Operational clothing is then donned over the NTS suit and includes combat boots (sometimes worn with overboots), protective gloves and face and respiratory protection provided by a standard negative-pressure military respirator.

Level A, Level B and Level C Suits

Customary in the protective suit industry, three types of protective garments are generally recognised, namely Level A, Level B and Level C suits:

Level A (Gas-Tight) Suit: The most comprehensive protection is provided by Level A (Gas-Tight) suits. These suits are fully encapsulating, with attached gloves and booties. They must be worn with self-contained breathing apparatus (SCBA) and additional overboots. They are intended for use in the most hazardous situations where any skin contact with vapours could be dangerous. Some suits may provide additional flash fire protection. Suits may be intended for multiple uses or may be for limited re-use.

Level B Suit: A Level B suit is designed for liquid protection only, which may be achieved in a variety of designs. Typically they would be a one-piece coverall design, with separate gloves, boots and attached hood worn over a respirator. The materials of which they are constructed must be resistant to liquid penetration, and closures should be splash-proof. However vapours can enter through closures and thus they are not vapour protective. Level B implies that the suit is worn with SCBA.

Level C Suit: A Level C suit is subject to the same design requirements as a Level B suit, the only difference being that the Level C suit is worn with a negative pressure facepiece respirator.

Results

FIGS. 3(*a*) to (*e*) show the results of VAPRO suit system experiments, expressed in terms of the geometric mean PFs at 27 body regions, for a number of protective clothing configurations involving the NTS suit worn underneath other operational clothing. The clothing configurations include (a) NTS suit with Level C wind-impermeable coveralls (low wind conditions), (b) NTS suit with Level C wind-impermeable coveralls (standard wind conditions), (c) NTS suit with aircrew/infantry combat clothing, (d) NTS suit with civilian casual wear, and (e) NTS suit with bomb disposal overgarment. The experiments completed on the Level C wind-impermeable coveralls and civilian casual wear have a maximum assigned PF of 10000 based on the minimum detection limit. The experiments with the NTS suit worn under the aircrew/infantry combat clothing and the bomb disposal overgarment have a maximum assigned PF of 2000. In either case, PFs reported to be the maximum assigned value actually represent PFs of at least that value or higher.

The NTS suit worn underneath the Level C wind-impermeable coverall with conventional (non air-tight) closures in low wind conditions has been shown to provide a very high degree of protection (FIG. 3*a*), generally only matched by the protection performance for a fully encapsulated Level A protective suit with self-contained breathing apparatus (see FIG. 4). The maximum assigned PF for the Level A experimental data is 3500. Notably, when a Level C wind-impermeable suit with conventional (non air-tight) closures is worn with no NTS carbon adsorbent suit underneath, the protection performance is generally extremely poor (see FIG. 5); the chemical vapour does in fact readily penetrate through the conventional closures to reach the skin. Note the factor of 3 to 6 degradation in the PFs at the wrist and ankles.

The results presented in FIG. 3 are to be compared to those obtained for a conventional chemical protective overgarment (see FIG. 6) and lightweight standalone suit (see FIG. 7). It is very evident that the protection performance of the protective clothing configurations involving the NTS suit worn underneath other operational clothing is superior to that of typical conventional chemical protective overgarments and standalone suits. Most of the PFs measured at the skin under the NTS/operational clothing configurations are above 1000 and many approach the maximum assigned PF for the given experimental conditions. The conventional suits typically provide PFs ranging from 50 to 1000, with most lying in the range between 100 and 500.

The VAPRO system level experiments are very sensitive to NTS suit design parameters. FIG. 8 illustrates the type of PF profile that is obtained from a NTS suit/aircrew combat coverall configuration with fit problems at the neck. In this instance the NTS suit was lined with a fire retardant material. FIG. 9 shows a PF profile for a NTS suit/infantry combat clothing configuration where the NTS suit was modified to incorporate passive venting under the arm (axillae regions) to aid in body cooling. Relatively poor PFs are associated with the problem areas on these suits. It is evident that the problem areas can affect the protection at adjacent body regions as well.

The primary reason for the improved performance of the NTS suit is the close-fitting design. The close fit means that the air space between the NTS suit and the skin is very small. This provides for a greater efficiency of scavenging and adsorption by the carbon in the NTS garment due, in part, to shorter diffusion paths. In addition, the close fit of the NTS suit effectively eliminates the bellowing effect, resulting in little, if any, air forcibly penetrating through the closures of the suit. When a NTS suit is worn under specialized operational clothing which then bellows during active wear, the air/vapour will be drawn into the air space between the NTS suit and the outer garment rather than between the NTS suit and the skin. Once in this air space, to reach the skin the vapour must still permeate through the NTS carbon adsorbent layer. Thus direct, unfiltered exposure to the skin by harmful chemical vapours is avoided. This is markedly different than what occurs with conventional overgarment or standalone chemical protective suits. Vapour penetrating through closures on these garments does go into the underlying air space that is immediately adjacent to the skin and is then free to be absorbed by the skin because the carbon adsorbent layer is generally laminated within the fabric system and not held close against the skin.

CONCLUSIONS

It is concluded that the NTS suit when worn under a variety of operational configurations provides system level protection performance against vapour challenges equivalent or superior to that of standalone chemical protective suits constructed from light-weight carbon adsorbent fabrics. The NTS suit concept is extremely well suited from a protection and functionality point of view for a niche group of users that require chemical vapour protection but cannot, for operational reasons, wear standard chemical protective suits.

As can be seen from the foregoing, the present invention provides thin, stretchable chemical vapour protective garment for wearing next-to-skin. Besides the disclosed preferred embodiment, other thin, stretchable chemical vapour protective garments are contemplated by and are within the scope of the present invention. Accordingly, it is to be understood that the embodiments and variations shown and described herein are merely illustrative of the principles of this inventions and that various modifications may be implemented by those skilled in the art without departing from the scope and spirit of the invention.

We claim:

1. A thin protective garment that is worn next-to-skin, said garment consisting of a pant and a jersey, wherein said garment is constructed from a stretchable fabric containing an organic chemical vapour absorbent, wherein said garment has a total thickness not exceeding 1.0 mm, and wherein said garment has a mean body region protection factor of approximately 2000 or more.

2. The next-to-skin protective garment of claim 1, wherein said organic chemical vapour adsorbent fabric is made from carbon adsorbent fabrics.

3. The next-to-skin protective garment of claim 2, wherein said carbon adsorbent fabric is selected from a carbon impregnated stretch-nylon or a commercially available activated carbon knit.

4. The next-to-skin protective garment of claim 3, wherein said carbon adsorbent fabric is selected from a carbon impregnated stretch-nylon laminated to a knit or a commercially available activated carbon knit laminated between two thin knits.

5. The next-to-skin protective garment of claim 1, wherein said garment is one of a one-piece, two-piece or three-piece whole-body integral design.

6. The next-to-skin protective garment of claim 1, wherein said garment further provides with an integral hood.

7. The next-to-skin protective garment of claim 1, wherein no extraneous space between the skin of the wearer and said next-to-skin protective garment is provided.

8. The next-to-skin protective garment of claim 1, wherein only minimal air space between the skin of the wearer and said next-to-skin protective garment is provided.

9. The next-to-skin protective garment of claim 1, wherein operational clothing is worn over said next-to-skin protective garment.

* * * * *